United States Patent [19]

Mizutani et al.

[11] 3,975,125

[45] Aug. 17, 1976

[54] OIL SEAL ASSEMBLY FOR ROTARY ENGINE

[75] Inventors: Kunihiko Mizutani; Takami Aoyama; Kazuhiro Kawamura, all of Toyota, Japan

[73] Assignee: Toyota Jidosha Kogyo Kabushiki Kaisha, Japan

[22] Filed: Sept. 11, 1974

[21] Appl. No.: 504,896

[30] Foreign Application Priority Data

May 2, 1974 Japan ..... 49-49522[U]

[52] U.S. Cl. ..... 418/142; 277/136

[51] Int. Cl.[2] ..... F04C 27/00

[58] Field of Search ..... 418/142, 144; 277/136, 277/137, 160, 161

[56] References Cited

UNITED STATES PATENTS

| | | | |
|---|---|---|---|
| 2,300,518 | 11/1942 | Phillips | 277/136 |
| 3,820,925 | 6/1974 | Uchiyama | 418/142 |
| 3,853,440 | 12/1974 | Green | 418/142 |

OTHER PUBLICATIONS

| | | | |
|---|---|---|---|
| B424,572 | 1/1975 | Rose | 418/142 |

*Primary Examiner*—C. J. Husar
*Assistant Examiner*—Leonard Smith
*Attorney, Agent, or Firm*—Toren, McGeady and Stanger

[57] ABSTRACT

An oil seal assembly is provided for a rotary engine in which an annular groove is formed in the side of the engine rotor with an oil seal ring being fitted within said annular groove. The oil seal ring is pressed against the side wall of the engine housing by annular spring means, and detent means are inserted between the ends of the annular spring means, the detent means being engaged in recesses carved in the innermost wall of the oil seal ring and in the bottom wall of the annular groove of the rotor to restrain relative motion therebetween during rotation of the rotor.

8 Claims, 5 Drawing Figures

OIL SEAL ASSEMBLY FOR ROTARY ENGINE

BACKGROUND OF THE INVENTION

The present invention relates generally to oil sealing assemblies, and more particularly to an oil sealing device for maintaining an adequate seal between the rotor side and the side of a housing of a rotary engine. More specifically, the invention also relates to means for retaining an oil seal ring in fixed relationship relative to the engine rotor during rotation thereof.

In conventional oil sealing devices for rotary engines, an annular groove is provided in each of the sides of the engine rotor and an oil seal ring is fitted within said grooves. The oil seal ring is normally fixed in place by a pin in order to prevent wear caused by rotation or movement of the ring. That is, when the engine rotor is rotating, rotation of the oil seal ring itself will cause deleterious effects due to wear of an O-ring or spring cooperatively arranged in engagement with the oil seal ring thereby resulting in a reduction in the durability of the oil seal assembly.

Additionally, the amount of space available for setting of pins and the like, as well as the space between the outer peripheral edge of the rotor and the annular groove in which the oil seal ring is fitted, is very limited so that mounting of a pin or similar element in such limited space creates significant difficulties. Furthermore, in this type of oil sealing device, it is found that axial movement of the oil seal ring becomes awkward during use.

In other known oil seal devices, in order to prevent undesired rotation of the oil seal ring, both ends of the spring adapted to press the oil seal ring against the side housing of the rotor are secured either in recesses or against protuberances provided in both the annular groove and the oil seal ring. In such cases, both ends of the undulated spring must be fixed in recesses or the like in order to inhibit rotation of the oil seal ring. As a result, the direction or positioning of the spring must be effected in a particular predetermined manner thereby causing inconvenience in the assembly of the oil seal.

The present invention is intended to prevent wear of the oil seal ring of an oil sealing assembly in a rotary engine, as well as wear of the O-ring or spring incorporated in the oil seal device, by inhibiting movement of the oil seal ring during rotation of the rotor thereby to improve the tightness and durability of the sealing device.

SUMMARY OF THE INVENTION

Briefly, the present invention may be described as an oil seal assembly for a rotary engine including a rotor having a pair of sides on which annular grooves for receiving said oil sealing assembly are formed, a housing having the rotor rotatably mounted therein, and side walls defined by the housing closely adjacent said rotor sides and arranged to have said rotor sides move relative thereto upon rotation of said rotor, said assembly comprising, in combination, an oil seal ring fitted in each of said annular grooves, spring means engaged between the annular groove and the oil seal ring for pressing the oil seal ring against said housing side walls during rotation of the rotor, detent means interposed within the annular groove between said oil seal ring and said rotor, and detent means including first and second engagement ends, first detent engaging means defined on said oil seal ring, and second detent engaging means defined on said rotor within said annular groove. The first and second detent engaging means are located to be engaged, respectively, by the first and second engagement ends of the detent means thereby to prevent relative rotation between the oil seal ring and the rotor during rotation of the rotor.

In a preferred embodiment of the invention the detent means are formed as a generally X-shaped member and the first and second detent engaging means comprise a pair of oppositely directed recesses formed, respectively, in the oil seal ring and in the annular groove.

By a further aspect of the invention the detent means may comprise an integrally formed member including a pair of oppositely directed bowed pieces integrally joined together along a mid-portion of their lengths. By another aspect of the invention the detent means may comprise a pair of oppositely directed generally S-shaped pieces integrally joined together along a mid-portion of their lengths.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
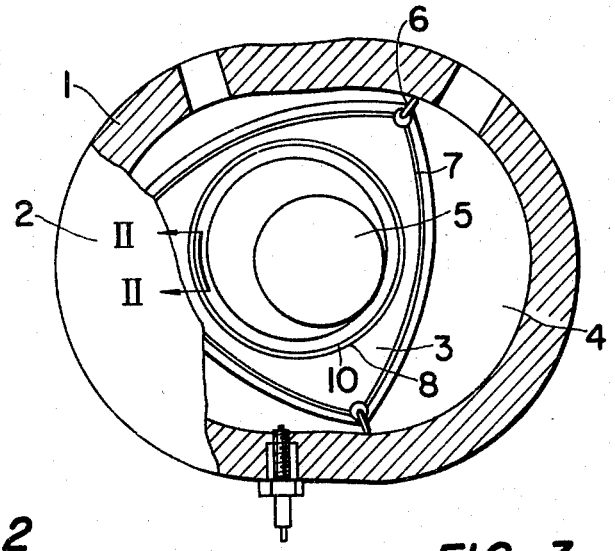
FIG. 1 is a sectional front view of a rotary engine including an oil seal device in accordance with the present invention.
Figure 2:
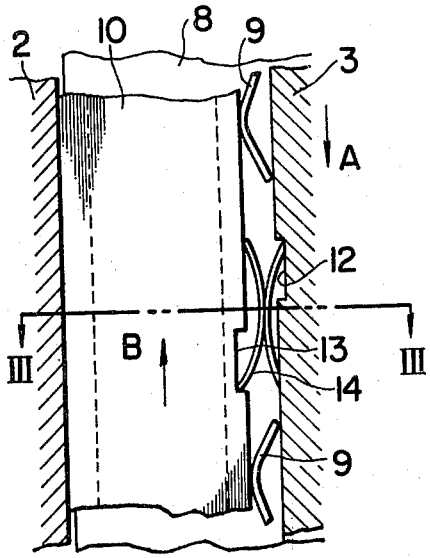
FIG. 2 is a sectional view taken along the line II—II of FIG. 1.
Figure 3:
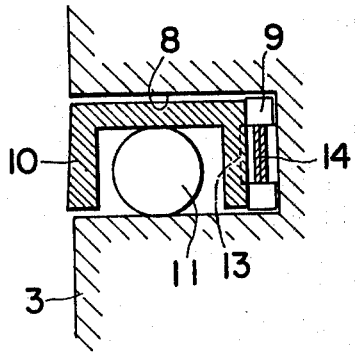
FIG. 3 is a sectional view taken along the line III—III of FIG. 2.

Referring now to the drawings, and more particularly to FIGS. 1 – 3 thereof, an oil sealing assembly in accordance with the present invention is shown included in a rotary engine having a rotor 3 which is eccentrically rotatably mounted in a housing comprised of a peripheral wall 1 and a side wall 2. The operating phases of the engine, such as the suction, compression, explosion and exhaust strokes, repeatedly occur within an operating chamber 4 formed by the outer peripheral surface of the rotor 3 and the inner peripheral surface of the rotor housing, whereby the rotor 3 is forced to undergo eccentric rotations causing corresponding rotations of an output shaft 5.

An apex seal 6 is provided at each apex of the rotor 3 at its outer peripheral surface, and a side seal 7 is provided along the outer peripheral edge of each side of the rotor 3 in proximity thereto. Also provided in each rotor side is an annular groove 8 located radially inwardly of the side seal 7, with an oil seal ring 10 being fitted within the groove 8 so as to be pressed against the side wall 2 of the housing by spring means 9.

The oil seal ring 10 has a generally U-shaped sectional configuration, as best seen in FIG. 3, extending with its open side directed radially inwardly of the rotor. An O-ring 11 is secured within the U-shaped oil seal ring 10 to maintain a tight seal between the annular groove 8 and the oil seal ring 10.

The oil seal ring 10 also functions to prevent lubricating oil on the output shaft 5 from leaking into the operating chamber 4. The spring 9 is of a length sufficient to substantially span around the annular groove 8.

Provided at a location in the bottom or innermost wall of the annular groove 8 is a recess 12 which is spaced from both ends of the spring 9, with another recess 13 being provided at a location in the face or innermost wall of the seal ring 10 which is juxtaposed adjacent the bottom face of the annular groove 8 in opposed relationship thereto and slightly spaced therefrom. It will be noted that the recess 13 is slightly spaced circumferentially from the recess 12.

Disposed within the annular groove 8, between the bottom wall thereof and the innermost wall of the oil seal ring 10, is a detent means 14, shown in FIG. 2 in the form of an X-shaped member having engagement ends adapted to be engaged within the recesses 12 and 13 respectively. As seen in FIG. 2, the detent 14 is arranged such that two of its opposed opposite ends are secured one within the recess 12 and the other within the recess 13, while the remaining two opposed opposite ends are maintained disengaged between the oil seal ring 10 and the bottom wall of the annular groove 8.

The embodiment inhibits movement of the oil seal ring 10 in a direction contrary to the direction of rotation of the rotor 3 while at the same time permitting axial movement of the ring 10. Fitting of the detent 14 between both the recesses 12 and 13 is effected in a manner whereby the detent 14 is first placed within the annular groove 8 along with the spring 9, with the oil seal ring 10 being subsequently fitted within the groove 8 and with the rotor then being turned so as to cause the detent 14 to move in the annular groove 8 to occupy the position desired between the recesses 12 and 13 whereby movement of the oil seal ring 10 is checked.

The recesses provided in the annular groove 8 and in the oil seal 10 may be replaced by other suitable detent engaging means such as protuberances which may extend from a wall of the ring 10 and the annular groove 8 to engage the detent means in a manner whereby the function of the detent means may be basically similar to that previously described.

The detent means 14 may be shaped and formed in various configurations. For example, as shown in FIG. 2, the detent 14 is comprised of two arc-shaped steel plates arranged back-to-back and joined together along their mid-portions. Thus, it will be seen that the detent means 14 may be comprised of a generally X-shaped member located in the position shown in FIG. 2.

Figure 4:
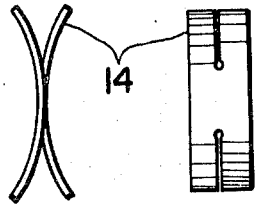
FIGS. 4 and 5 are each front and side views of two different forms of detent means in accordance with the present invention.

Alternatively, the detent means 14 may be formed from a single steel plate including a pair of oppositely directed sections which are integrally joined together along a mid-portion of their lengths. For example, as shown in FIG. 4, such a detent 14 is formed by partially cutting a single steel plate along its center line while retaining the mid-portion thereof intact thereby to form a pair of oppositely directed sections which are bent in a bowed configuration to form a generally X-shaped arrangement.

Figure 5:
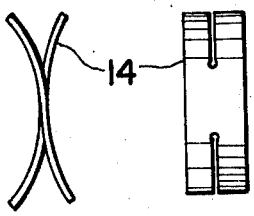

Alternatively, the two sections of the steel plate may each be oppositely bent in the form of a generally S-shaped configuration as shown in FIG. 5, with the two S-shaped sections combining to form an overall generally X-shaped arrangement.

Additionally, inasmuch as, as shown in FIG. 2, the detent means 14 are engaged within the recesses 12 and 13 at two opposite ends, it will be apparent that one of the sections of the detent 14 shown in FIG. 5 may be eliminated without inpairing the functioning of the detent 14. For example, by dividing the two S-shaped sections shown in FIG. 5 and utilizing one S-shaped section only, an effect similar to that obtained with the configuration of FIG. 2 may be achieved.

In the oil seal assembly constructed as described above, when the rotor 3 is rotated, the oil seal ring 10 will be pressed against the side wall 2 by the force of the spring 9 and will be rotated while scraping oil film from the side wall 2, thereby constantly securing a tight seal between the side of the rotor 3 and the side wall 2.

In this case, if the rotor 3 is rotated in the direction of an arrow A seen in FIG. 2, a slight friction develops between the oil seal ring 10 and the side wall 2 thereby giving rise to a force tending to rotate the oil seal ring 10 in the direction of the arrow B shown in FIG. 2. However, since the oil seal ring 10 is held in position relative to the rotor 3 by means of the detent 14 engaged between the recesses 12 and 13, the ring 10 will not be moved relative to the rotor 3 but will be allowed to rotate in a fixed position relative to the rotor 3.

During rotation of the rotor 3, the oil seal ring 10 is forced to move axially of the rotor 3 against the opposing force of the spring 9 while sliding along the side wall 2, but in such case since the two ends of the detent 14 which are not engaged in the recesses 12 and 13 may be permitted to slide against the annular groove 8 and against the wall of the seal ring 10, the detent 14 may be flexed or compressed between the ring 10 and the rotor 3 so as to impede the axial movement of the ring 10 relative to the rotor 3. Thus, due to the structural configuration of the assembly of the invention, the detent 14 may be flexed to accommodate relative axial movement of the oil seal ring 10.

As described above in accordance with the present invention, detent means are provided disposed between the engaging portions arranged in the annular groove and the oil seal ring to thereby secure the oil seal ring against rotation within the annular groove during rotation of the rotor so that no possibility exists that the oil seal ring itself will be damaged with wear of the O-ring and/or the spring thereby providing a significant improvement in the durability of the device.

Furthermore, since the detent means is constituted from two crossed members forming a generally X-shape, there is no need to consider the direction of mounting when incorporating such detent means in position in the oil seal device and thereby the assembly operation of the device is simplified and made easier.

While specific embodiments of the invention have been shown and described in detail to illustrate the application of the inventive principles, it will be understood that the invention may be embodied otherwise without departing from such principles.

What is claimed is:

1. An oil seal assembly for a rotary engine including a rotor having a pair of sides, a housing having said rotor rotably mounted therein, and side walls defined by said housing, closely adjacent said rotor sides and arranged to have said rotor sides move relative thereto upon rotation of said rotor, said assembly comprising, in combination, an annular groove formed in each of said rotor sides, said annular grooves including a bottom wall, an oil seal ring fitted in each of said annular grooves, said oil seal rings including an end wall facing said bottom wall of said annular grooves, spring means engaged between said annular grooves and said oil seal rings for pressing said oil seal rings against said housing side walls during rotation of said rotor, detent means separately provided from said spring means interposed within each of said annular grooves between said oil seal ring and said rotor, said detent means having a pair of oppositely directed bowed members joined together along a mid portion of their lengths in a back-to-back arrangement, first detent engaging means defined on said oil seal ring at said end wall thereof facing said bottom wall of said annular groove, and second detent engaging means defined on said rotor within said annular groove at said bottom wall thereof, whereby said detent means is adapted to be interposed within said annular groove in such a manner that said detent means is compressed, said first and second detent engaging means being located to be engaged by ends of said pair of oppositely directed bowed members to prevent relative rotation between said oil seal ring and said rotor during rotation of said rotor.

2. An oil seal assembly for a rotary engine including a rotor having a pair of sides, a housing having a said rotor rotably mounted therein, and side walls defined by said housing closely adjacent said rotor sides and arranged to have said rotor sides move relative thereto upon rotation of said rotor, said assembly comprising, in combination, an annular groove formed in each of said rotor sides, said annular grooves including a bottom wall, an oil seal ring fitted in each of said annular grooves, said oil seal rings including an end wall facing said bottom wall of said annular grooves, spring means engaged between said annular grooves and said oil seal rings for pressing said oil seal rings against said housing side walls during rotation of said rotor, detent means separately provided from said spring means interposed within each of said annular grooves between said oil seal ring and said rotor, said detent means having an integrally formed member including a pair of oppositely directed bowed sections integrally joined together along a mid portion of their lengths, first detent engaging means defined on said oil seal ring at said end wall thereof facing said bottom wall of said annular groove, and second detent engaging means defined on said rotor within said annular groove at said bottom wall thereof, said detent means being symmetrical and composed essentially of elastic material whereby said detent means is adapted to be interposed within said annular groove in such a manner that said detent means is compressed, said first and second detent engaging means being located to be engaged by ends of said pair of oppositely directed bowed sections to prevent relative rotation between said oil seal ring and said rotor during rotation of said rotor.

3. An oil seal assembly for a rotary engine including a rotor having a pair of sides, a housing having said rotor rotably mounted therein, and side walls defined by said housing closely adjacent said rotor sides and arranged to have said rotor sides move relative thereto upon rotation of said rotor, said assembly comprising, in combination, an annular groove formed in each of said rotor sides, said annular grooves including a bottom wall, an oil seal ring fitted in each of said annular grooves, said oil seal rings including an end wall facing said bottom wall of said annular grooves, spring means engaged between said annular grooves and said oil seal rings for pressing said oil seal rings against said housing side walls during rotation of said rotor, detent means separately provided from said spring means interposed within each of said annular grooves between said oil seal ring and said rotor, said detent means having a pair of oppositely directed generally S-shaped sections integrally joined together along a mid portion of their lengths, first detent engaging means defined on said oil seal ring at said end wall thereof facing said bottom wall of said annular groove, and second detent engaging means defined on said rotor within said annular groove at said bottom wall thereof, said detent means being symmetrical and composed essentially of elastic material whereby said detent means is adapted to be interposed within said annular groove in such a manner that said detent means is compressed, said first and second detent engaging means being located to be engaged by ends of said S-shaped sections to prevent relative rotation between said oil seal ring and said rotor during rotation of said rotor.

4. An oil seal assembly for a rotary engine including a rotor having a pair of sides, a housing having said rotor rotably mounted therein, and side walls defined by said housing closely adjacent said rotor sides are arranged to have said rotor sides move relative thereto upon rotation of said rotor, said assembly comprising, in combination, an annular groove formed in each of said rotor sides, said annular grooves including a bottom wall, an oil seal ring fitted in each of said annular grooves, said oil seal rings including an end wall facing said bottom wall of said annular grooves, spring means engaged between said annular grooves and said oil seal rings for pressing said oil seal rings against said housing side walls during rotation of said rotor, detent means separately provided from said spring means interposed within each of said annular grooves between said oil seal ring and said rotor, said detent means comprising a generally X-shaped member, first detent engaging means defined on said oil seal ring at said end wall thereof facing said bottom wall of said annular groove, and second detent engaging means defined on said rotor within said annular groove at said bottom wall thereof, whereby said detent means is adapted to be interposed within said annular groove in such a manner that said detent means is compressed, said first and second detent engaging means being located to be engaged by ends of said generally X-shaped member to prevent relative rotation between said oil seal ring and said rotor during rotation of said rotor.

5. An oil seal assembly according to claim 4, wherein said detent means is adapted to be assembled in said rotary engine in such a manner that said detent means is compressed by said bottom wall of said annular groove and the innermost wall of said oil seal ring.

6. An oil seal assembly according to claim 4, wherein said detent means comprises a single steel plate which is partially cut along the center line thereof but is retained intact at the mid portion thereof thereby to form said X-shaped member.

7. An oil seal assembly according to claim 4, wherein said spring means has two ends which are spaced relative to each other.

8. An oil seal assembly according to claim 7, wherein said detent means is adapted to be inserted between each said end of said spring means.

* * * * *